United States Patent [19]

Darling

[11] 4,169,295

[45] Oct. 2, 1979

[54] MATTRESS STRUCTURE

[76] Inventor: Michael E. Darling, 110 Geneva Walk, Long Beach, Calif. 90803

[21] Appl. No.: 841,828

[22] Filed: Oct. 13, 1977

[51] Int. Cl.[2] ..... A47C 27/08

[52] U.S. Cl. ..... 5/450; 5/453

[58] Field of Search ..... 5/12, 13, 343, 365, 5/369; 46/244; 272/100, 102, 131; 280/728, 732, 743

[56] References Cited

U.S. PATENT DOCUMENTS

| | | | |
|---|---|---|---|
| 2,372,218 | 3/1945 | Manson et al. | 5/365 |
| 3,079,613 | 3/1963 | Blecker | 5/13 |
| 3,643,971 | 2/1972 | Kushnick | 280/732 |
| 3,792,501 | 2/1974 | Kery | 5/12 R |
| 3,879,598 | 4/1975 | Darling | 5/371 |
| 3,910,595 | 10/1975 | Kaltes et al. | 280/732 |

*Primary Examiner*—Casmir A. Nunberg
*Attorney, Agent, or Firm*—Jack C. Munro

[57] ABSTRACT

A mattress structure wherein a frame includes an activatable air blower which is to be used to inflate a mattress which is to be stored in a collapsed position within a storage compartment of the frame. Upon activation of the blower, the mattress is to automatically extend from the frame and will normally be located upon a floor forward of the frame in an inflated condition. During extension of the mattress, the mattress storage compartment is automatically closed.

22 Claims, 9 Drawing Figures

MATTRESS STRUCTURE

BACKGROUND OF THE INVENTION

The mattress structure of this invention is to be described in conjunction with a sofa for illustration purposes only as the structure could be employed within any type of furniture.

The use of sofas or davenports which can be made into a bed has been well known for a substantial period of time. The conventional type of sofa bed comprises a foldable mattress which is mounted upon a foldable frame. The frame is foldable into the sofa and when such is accomplished the sofa bed almost precisely resembles a conventional sofa. Upon extraction of the mattress into the extended position, the mattress is then used as a conventional bed.

The use of such conventional foldable mattresses within a sofa has several disadvantages. The first disadvantage is that they are quite large and heavy. Frequently, such sofas are used in apartment dwellings and other similar types of confined quartered dwellings. Frequently, these type of dwellings are located up a series of stairs. It is quite difficult to move a large and heavy type of sofa up several flights of stairs in order to locate such within the apartment.

A second disadvantage of such conventional foldable mattress sofa beds is that they are quite complex in construction. This complexity inherently raises manufacturing costs and therefore the consumer selling price is quite high.

SUMMARY OF THE INVENTION

The structure of this invention comprises an air filled mattress which, in the collapsed state, is to be rolled up and contained within the compartment located within the frame of the sofa. Also located within the frame of the sofa is an electrically activated air blower which, when activated, causes the air filled mattress to begin to inflate while still within the storage compartment. The inflation of the mattress causes the access panel to be delatched permitting the mattress to move to the floor in front of the sofa and be extended. At the same time, an inner panel assumes the position of the access panel when closed thereby giving the appearance that the sofa is a completely closed unit even with the mattress extended.

The primary objective of the structure of this invention is to construct an extremely compact device, when deflated, that could be mounted within practically any type of frame.

DETAILED DESCRIPTION OF THE SHOWN EMBODIMENT

Figure 1:
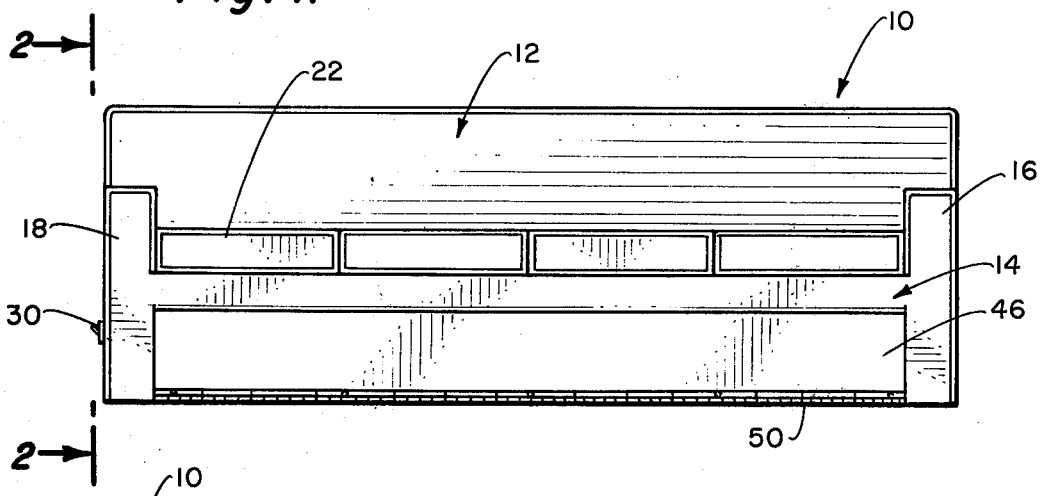
FIG. 1 is a front view of a sofa bed constructed in accordance with this invention.
Figure 2:
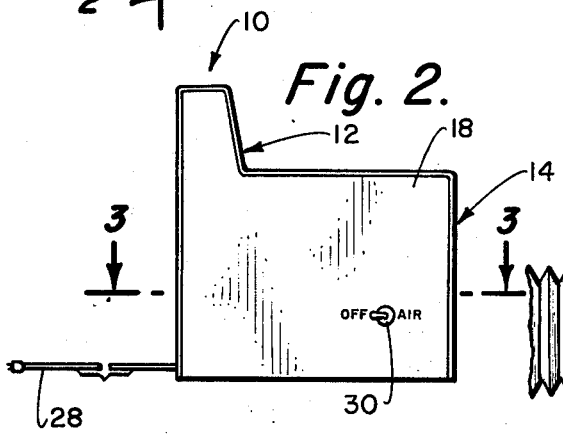
FIG. 2 is a side view of the sofa bed of this invention taken along line 2—2 of FIG. 1.
Figure 4:
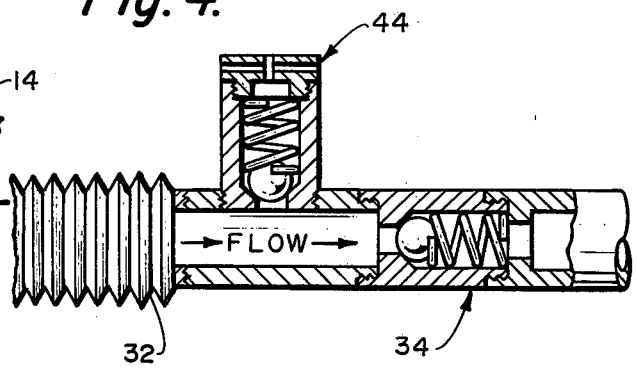
FIG. 4 is a cross-sectional view through the air passage conduit incorporated within the structure of this invention taken along line 4—4 of FIG. 3.
Figure 3:
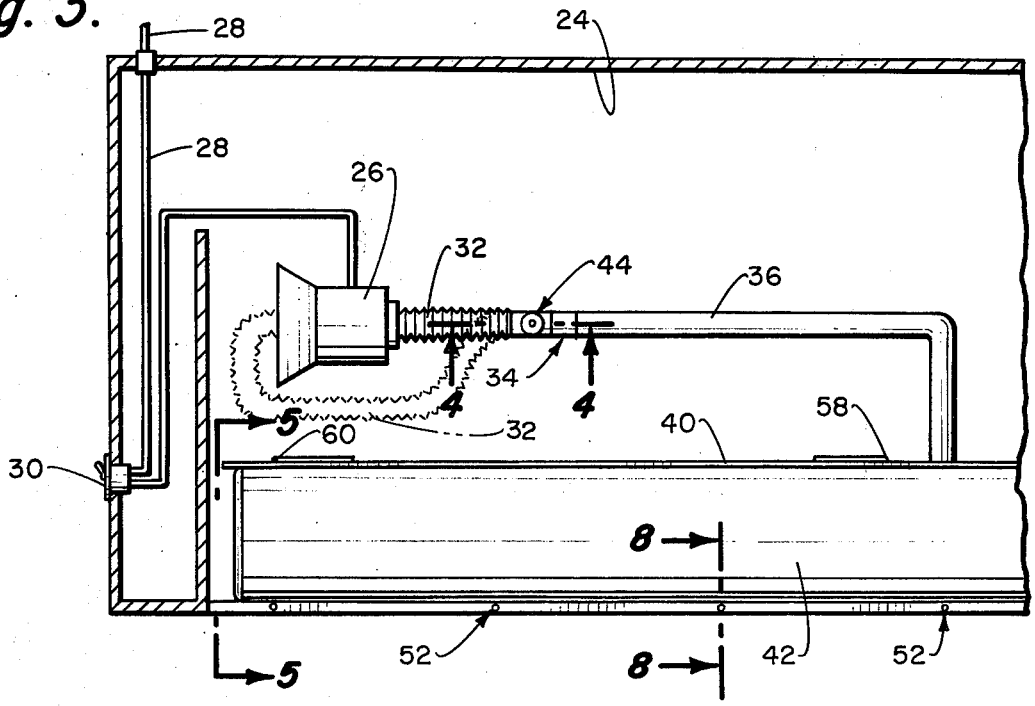
FIG. 3 is a cross-sectional view through the sofa bed of this invention taken along line 3—3 of FIG. 2.

Referring particularly to the drawings, there is shown a sofa bed 10 which includes a sofa frame which is formed to include a sofa back 12, a sofa base 14 and arm rests 16 and 18. The upper surface of the base 14 is formed into a seat base 20. Upon the seat base 20 is to be placed appropriate cushioning material such as pillow cushions 22.

The interior of the sofa base 14 comprises a hollow chamber 24. Fixedly mounted within the hollow chamber 24 is an air blower 26 which is deemed to be a conventional type of air blower which incorporates an electric motor (not shown). The air blower is driven electrically through the electrical conduit 28 from a source of electrical energy (not shown). A switch 30 is electrically connected within the conduit 28 to activate and deactivate the blower 26. The air from the blower 26 is to be supplied through air supply hose 32, through a spring biased one-way check valve assembly 34 to air supply conduit 36. The hose 32 is to be constructed to be bendable and extendable. This flexibility of hose 32 is for the purpose of permitting manual disconnection of the hose 32 from the exit side of blower 26 and reconnection of hose 32 to the inlet side of blower 26. When hose 32 is connected to inlet side of the blower 26, the blower functions to deflate the mattress 42. Therefore, the blower 26 can be used to not only deflate the mattress 42, but used to deflate the mattress 42 facilitating complete removal of the air and compact storage of such. The conduit 36 will preferably be constructed of a slightly flexible material usually of plastic or rubber. The conduit 36 is to extend through an elongated slot 38 formed within an inner panel 40. The conduit 36 connects to an inflatable mattress 42. The mattress 42 is stowable in a rolled up condition within the compartment 24 when deflated.

To prevent the air pressure within the mattress 42 exceeding a predetermined level, a conventional air pressure relief valve assembly 44 is connected in conjunction with the conduit 36. Upon the pressure within the mattress 42 exceeding a predetermined level, the pressurized air is vented to the atmosphere through the pressure relief valve assembly 44. It may be desirable to include an automatic shut-off device to become operational upon activation of relief valve assembly 44.

It is to be noted that valve assembly 44 is upstream of valve assembly 34. The reason for this is so the valve assembly 44 can only become activatable during inflation of the mattress 42. This prevents discharge of air through valve assembly 44 during pressure increases within the mattress 42 which would naturally occur during use of the mattress 42.

With the mattress 42 in the rolled up state (the stowed state) the mattress 42 is located in between an outer panel 46 and the inner panel 40. The outer panel 46 is attached to the base 48 of the frame 14 by means of a conventional elongated hinge assembly 50. The inner panel 40 is also hingedly connected to hinge assembly 50. This is accomplished by panel 46 having a plurality of cut-out sections, each about three inches in length, and a mating extension of panel 40 is located within each cut-out section. Each extension is attached to hinge 50.

Included within the free edge of the outer door 46 are a plurality of spring biased ball latching assemblies 52. Each of the ball latching assemblies 52 are to connect a ring shaped member 54 which is fixedly mounted within seat base 20. Each of the ball latching assemblies 52 are to be adjustable so as to vary the amount of extension of the ball 56 out from the free edge of the outer panel 46. As a result, the amount of latching force can be varied. This means, as the latching assemblies 52 wear, the latching assemblies 52 can be adjusted to more positively lock the outer panel 46 into the closed position.

The inner panel 40 has attached thereto a pair of torsion rods 58 and 60. Each torsion rod 58 and 60 have an inner right angled end 59 and 61, respectively, which are fixedly secured by brackets 68 to base 48. The torsion rods 58 and 60 have outer right angled ends 63 and 65, respectively, which are located against metal plates 70 and 72, respectively. Plates 70 and 72 are fixed upon the inside surface of the inner panel 40. During hinging movement of the inner panel 40 the ends 63 and 65 slide up on their respective plates 70 and 72.

Figure 5:
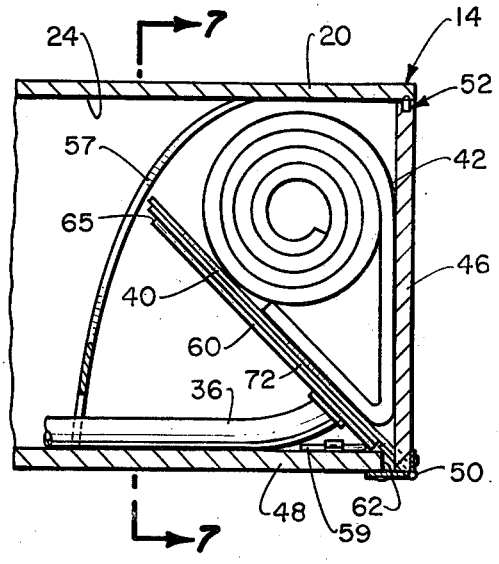
FIG. 5 is a cross-sectional view showing in more detail the mattress in the storage position taken along line 5—5 of FIG. 3.
Figure 6:
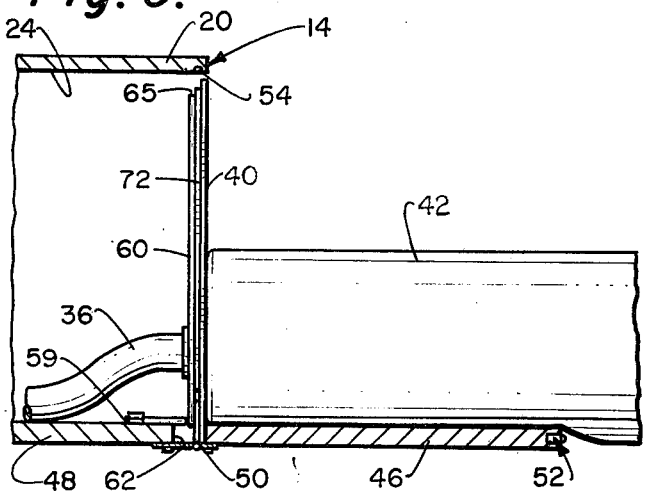
FIG. 6 is a view similar to FIG. 5 but showing the mattress in an extended position.
Figure 7:
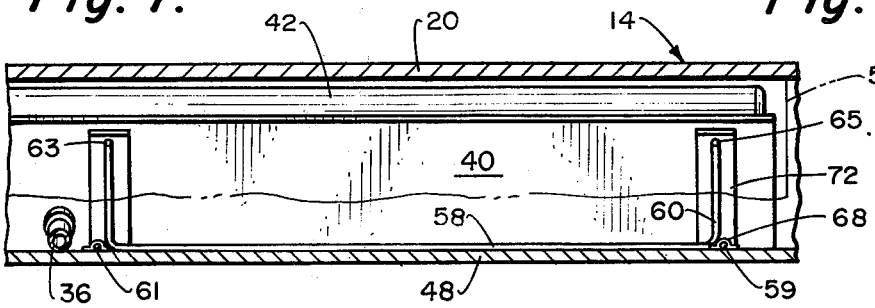
FIG. 7 is a cross-sectional view from the rear of the mattress storage compartment taken along line 7—7 of FIG. 5.
Figure 8:
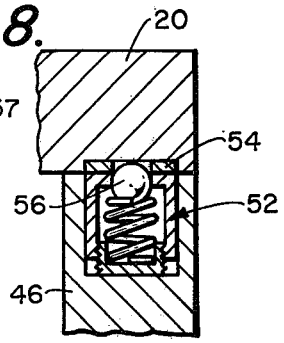
FIG. 8 is a cross-sectional view through one of the latches employed to latch the access door to the frame of the sofa bed taken along line 8—8 of FIG. 3.
Figure 9:
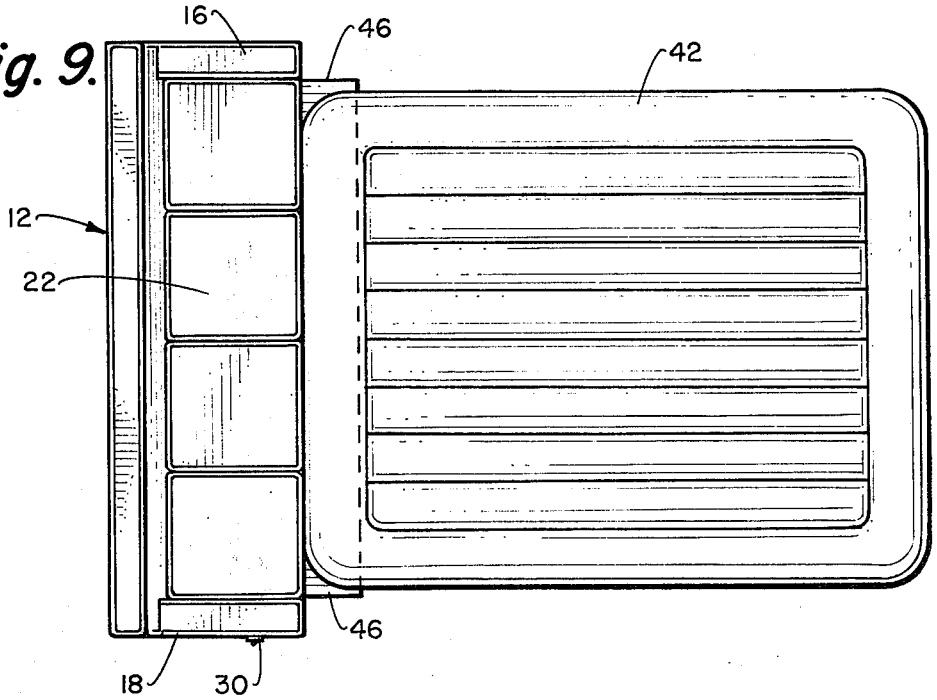
FIG. 9 is a top view of the sofa bed of this invention with the mattress extended.

When inserting of the inflatable mattress 42 to within the compartment 24, the inner panel 40 deflects into the compartment 24, such as shown in FIG. 5 of the drawings. This deflection is permitted due to the twisting of the central sections of each of the rods 58 and 60 in respect to their fixed right angle portions 59, 61, 63 and 65. Therefore, there is an inherently created bias tending to move the inner panel 40 to the position shown in FIG. 6. However, with the outer panel 46 closed and in the position shown in FIG. 5, the latching force of the latching assemblies 52 is such as to prevent this movement and therefore maintains the inflatable mattress 42 within the compartment 24. The mattress 42 is continuously pressed agains panel 46 by the bias of rods 58 and 60 against panel 40. Movement of the mattress 42 to within the aft portion of compartment 24 is prevented by walls 57 fixedly located between seat base 20 and base 48. Upon the initiating of the inflation procedure of the mattress 42, the expansion of the mattress 42 will cause the outer panel 46 to become unlatched and move to the position shown within FIG. 6 of the drawings. At the same time, the inner panel 40 is biased by the torsion rods 58 and 60 to the upright position shown within FIG. 6. Within a sofa, this location of inner panel 40 is important since the sofa may be used so panel 40 functions as a weight supporting member.

Although this invention has been described as being mounted within a sofa, it is considered to be within the scope of this invention to mount this invention in any reasonable piece of furniture such as a chair or table. Also, the device may be fixedly mounted as within a wall.

What is claimed is:

1. A mattress structure comprising:

a frame;

an interior chamber located within said frame;

an air mattress capable of being located within said interior chamber when in the collapsed position, said air mattress to be inflatable by means of an air blower, said air blower being located within said interior chamber, with said air mattress deflated and located within said interior chamber the said air mattress being in physical contact between an inner panel and an outer panel, with said mattress being deflated and stowed within said interior chamber the said outer panel being secured in a closed position with respect to said frame, with said inflatable mattress in the inflated condition the said mattress being displaced from said interior chamber and extending forward of said frame, with said mattress inflated the said inner panel being located substantially in the aforementioned closed position of said outer panel.

2. The mattress structure as defined in claim 1 wherein:

said outer panel including latching means to latch such in the closed position.

3. The mattress structure as defined in claim 2 wherein:

said inner panel being continuously resiliently biased towards said outer panel.

4. A mattress structure comprising:

a frame;

an interior chamber located within said frame;

an air mattress capable of being located within said interior chamber when in the collapsed position, said air mattress to be inflatable by means of an air blower, said air blower being located within said interior chamber, with said air mattress deflated and located within said interior chamber the said air mattress being in physical contact between an inner panel and an outer panel, with said mattress being deflated and stowed within said interior chamber the said outer panel being secured in a closed position with respect to said frame, with said inflatable mattress in the inflated condition the said mattress being displaced from said interior chamber and extending forward of said frame, with said mattress inflated the said inner panel being located substantially in the aforementioned closed position of said outer panel, said outer panel including latching means to latch such in the closed position, said inner panel being continuously resiliently biased toward said outer panel;

said resilient bias being provided by a pair of torsion spring members which are attached to said inner panel.

5. The mattress structure as defined in claim 1 wherein:

means connected with said air blower to cause deflation of said air mattress.

6. A mattress structure comprising:

a frame;

an interior chamber located within said frame;

an air mattress capable of being located within said interior chamber when in the collapsed position, said air mattress to be inflatable by means of an air blower, said air blower being located within said interior chamber, with said air mattress deflated and located within said interior chamber the said interior chamber being closed by an outer panel, with said mattress being deflated and stowed within said interior chamber the said outer panel being secured in a closed position in respect to said frame, with said inflatable mattress in the inflated condition the said mattress being displaced from said interior chamber and extending forward of said frame;

with said air mattress deflated and located within said interior chamber the said air mattress being located between an inner panel and an outer panel, with said mattress inflated the said inner panel being located substantially in the aforementioned said closed position of said outer panel, said outer panel having a first pivot axis, said inner panel having a second pivot axis, said first and second pivot axes being located parallel.

7. The mattress structure as defined in claim 6 wherein:

said first pivot axis coinciding with said second pivot axis.

8. The mattress structure as defined in claim 7 wherein:

said inner panel being continuously resiliently biased toward said outer panel.

9. The mattress structure as defined in claim 8 wherein:

said resilient bias being provided by a pair of torsion spring members which are attached to said inner panel.

10. A mattress structure comprising:

a frame;

an interior chamber located within said frame;

an air mattress capable of being located within said interior chamber when in the collapsed position, said air mattress to be inflatable by means of an air blower, said air blower being located within said interior chamber, with said air mattress deflated and located within said interior chamber the said interior chamber being closed by an outer panel, with said mattress being deflated and stowed within said interior chamber the said outer panel being secured in a closed position in respect to said frame, with said inflatable mattress in the inflated condition the said mattress being displaced from said interior chamber and extending forward of said frame; and wall means included within said interior chamber dividing said interior chamber into a pair of separate smaller chambers, with said mattress being deflated and being stowed within one of said smaller chambers the said wall means prevents movement of said mattress into the other of said smaller chambers.

11. The mattress structure as defined in claim 10 including:

an inner panel located within said smaller chamber that contains the said air mattress in the deflated state, said inner panel being movable within said smaller chamber, one edge of said inner panel being pivotly attached to said frame about a second pivot axis, the unattached edge of said inner panel being located directly adjacent said wall means during the entire pivoting movement of said inner panel.

12. The mattress structure as defined in claim 11 wherein:

said outer panel being pivotly attached to said frame about a first pivot axis, said first pivot axis coinciding with said second pivot axis, with said mattress inflated the said inner panel being moved to the position of said outer panel when in said closed position.

13. The mattress structure as defined in claim 12 wherein:

said inner panel being continuously resiliently biased toward said outer panel.

14. Mattress structure comprising:

a frame;

an interior chamber located within said frame;

an air mattress capable of being located within said interior chamber when in the collapsed position, said air mattress to be inflatable, with said inflatable mattress in the inflated condition, the said mattress being displaced from said interior chamber and extending forward of said frame;

wall means included within said interior chamber dividing said interior chamber into a pair of separate smaller chambers, with said mattress being deflated and being stowed within one of said smaller chambers the said wall means prevents movement of said mattress into the other of said smaller chambers.

15. The mattress structure as defined in claim 14 wherein:

with said air mattress deflated and located within said interior chamber the said interior chamber being closed by an outer panel.

16. The mattress structure as defined in claim 15 wherein:

with said air mattress being deflated and stowed within said interior chamber the said outer panel being secured in a closed position in respect to said frame.

17. The mattress structure as defined in claim 15 wherein:

with said air mattress deflated and located within said interior chamber the said air mattress being located between an inner panel and said outer panel, with said air mattress inflated the said inner panel being located substantially in the aforementioned said closed position of said outer panel.

18. Mattress structure comprising:

a frame;

an interior chamber located within said frame;

an air mattress capable of being located within said interior chamber when in the collapsed position, said air mattress to be inflatable, with said inflatable mattress in the inflated condition the said mattress being displaced from said interior chamber and extending forward of said frame;

wall means included within said interior chamber dividing said interior chamber into a pair of separate smaller chambers, with said mattress being deflated and being stowed within one of said smaller chambers a said wall means prevents movement of said mattress into the other of said smaller chambers;

with said air mattress deflated and located within said interior chamber the said interior chamber being enclosed by an outer panel;

with said air mattress deflated and located within said interior chamber the said air mattress being located between an inner panel and said outer panel, with said air mattress inflated the said inner panel being located substantially in the aforementioned said closed position of said outer panel; and said outer panel having a first pivot axis, said inner panel having a second pivot axis, said first and said second pivot axes being located parallel.

19. The mattress structure as defined in claim 18 wherein:

said first pivot axis coinciding with said second pivot axis.

20. The mattress structure as defined in claim 19 wherein:

said inner panel being continuously resiliently biased toward said outer panel.

21. The mattress structure as defined in claim 20 wherein:

said resilient bias being provided by a pair of torsion spring members which are attached to said inner panel.

22. The mattress structure as defined in claim 21 wherein:

said outer panel including latching means to latch said outer panel in said closed position.

* * * * *